United States Patent [19]

Bergrath et al.

[11] Patent Number: 4,573,575

[45] Date of Patent: Mar. 4, 1986

[54] NEEDLE PACKAGING

[75] Inventors: Siegmar Bergrath; Fritz Kappertz, both of Wurselen, Fed. Rep. of Germany

[73] Assignee: Singer Spezialnadelfabrik GmbH, Wurselen, Fed. Rep. of Germany

[21] Appl. No.: 672,649

[22] Filed: Nov. 19, 1984

[30] Foreign Application Priority Data

Dec. 23, 1983 [DE] Fed. Rep. of Germany ... 8336978[U]

[51] Int. Cl.[4] ..... B65D 85/24

[52] U.S. Cl. ..... 206/380; 206/443; 206/564

[58] Field of Search ..... 206/224, 371, 380–383, 206/443, 564, 565

[56] References Cited

U.S. PATENT DOCUMENTS

| | | | |
|---|---|---|---|
| 2,228,493 | 1/1941 | Will | 206/223 |
| 2,844,244 | 7/1958 | Hanson | 206/379 |
| 3,283,943 | 11/1966 | Carnelutti | 206/509 |
| 3,335,847 | 8/1967 | Murphy et al. | 206/380 |
| 4,186,073 | 1/1980 | Paganoni | 206/380 |

FOREIGN PATENT DOCUMENTS

| | | | |
|---|---|---|---|
| 1244689 | 9/1960 | France | 206/564 |
| 0676832 | 11/1964 | Italy | 206/371 |
| 0334415 | 11/1958 | Switzerland | 206/380 |

*Primary Examiner*—George E. Lowrance
*Assistant Examiner*—Jimmy G. Foster
*Attorney, Agent, or Firm*—Robert E. Smith; Edward L. Bell

[57] ABSTRACT

A plastic needle package is disclosed with parallel partitions defining compartments in which needle constraining projections are provided by controlled deformation of the partition top and to facilitate removal of needles each partition is interrupted between its ends to encourage bending of the package to expose needle extremities for access.

4 Claims, 9 Drawing Figures

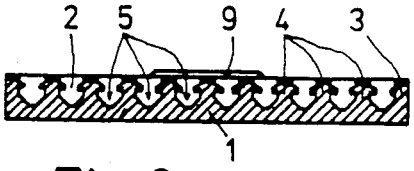
Fig. 2
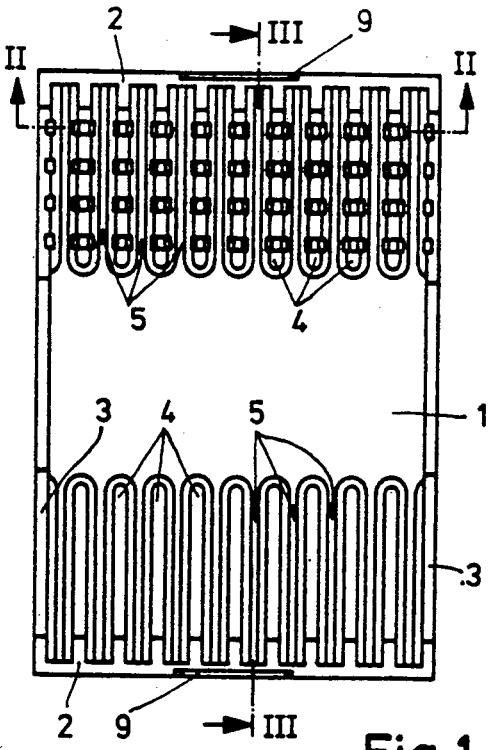
Fig. 1
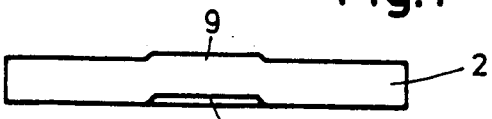
Fig. 5
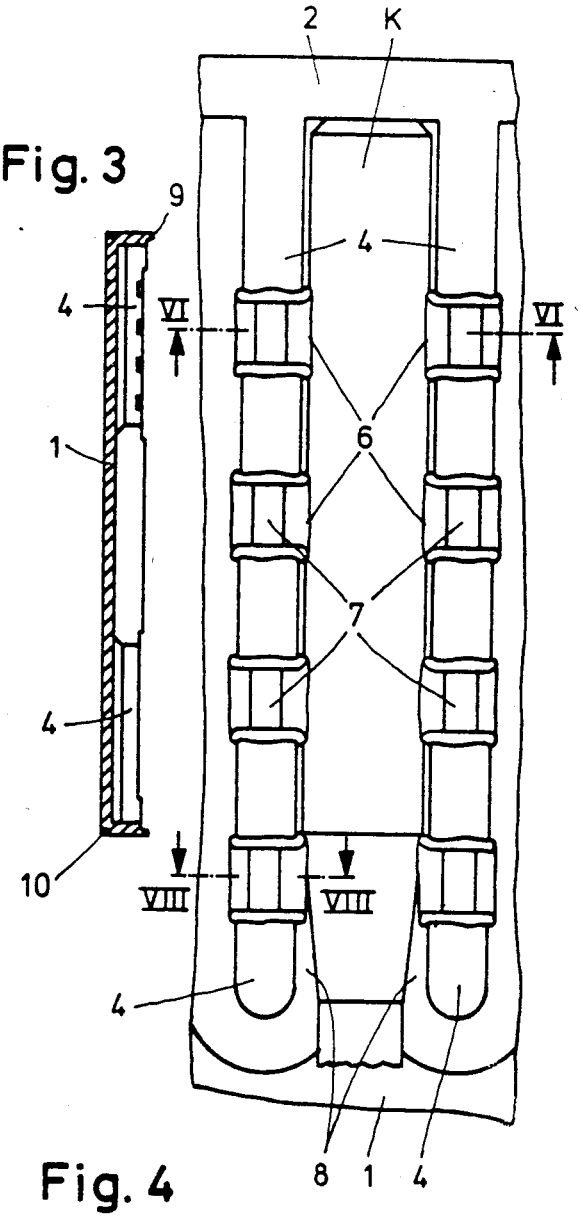
Fig. 3
Fig. 4

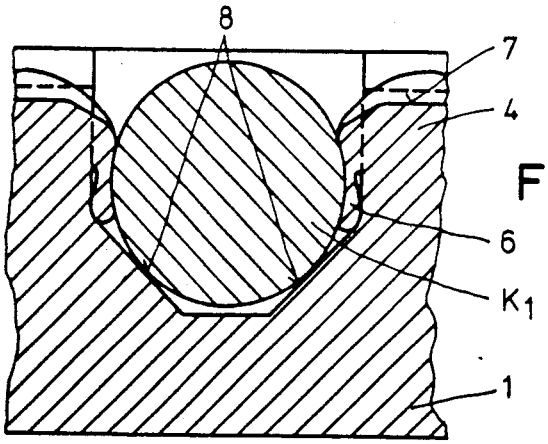
Fig. 6
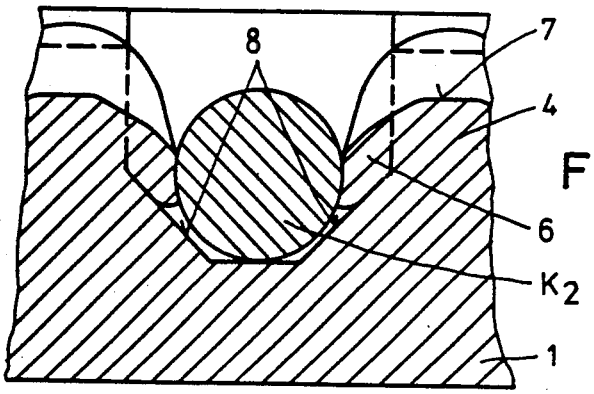
Fig. 7
Fig. 8
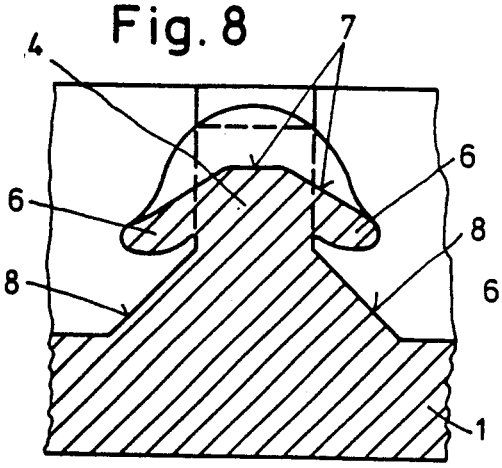
Fig. 9
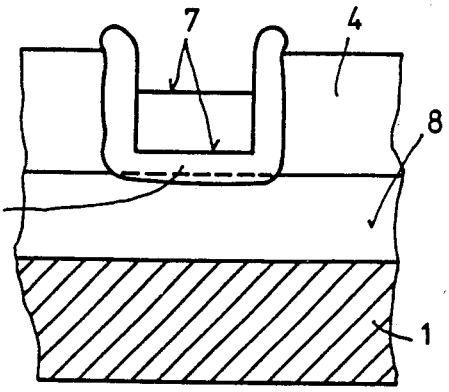

NEEDLE PACKAGING

DESCRIPTION

1. Field of the Invention

This invention concerns packaging for needles, particularly sewing machine needles. The packaging of this invention consists of a plate shaped base made of soft plastic, with front and side walls that project from the base and form a circumferential edge, and with partition walls running parallel to the sidewalls to form adjoining compartments each of which holds one needle, which can be held fast in the area of its head by means of projecting stops that work together in pairs, and which are formed out of the partition and sidewalls the height of which exceeds the needle head diameter.

Needles for industrial sewing machine use are usually packed in units of 100 needles. Because of the large number, removing these nail-like elements from such a large package entails a good deal of effort. For this reason, it has long been a goal of the needle industry to create a package for fewer industrial or household sewing machine needles, preferably ten, to simplify storage, and to diminish the effort involved in removing individual needles from the package.

2. Description of the Prior Art

The U.S. Pat. No. 4,186,073, Jan. 29, 1980 discloses a needle package of the general type described above and accommodating ten needles. In this prior patent although the needles lie parallel in the package, because the projecting stops extend each from only one side of the partition walls, the needle heads can be held fast at each end of the needle package compartments only in every other compartment, for which reason the needles must be positioned facing in alternating directions. Because of the alternate facing positions of the needles, it requires great effort to fill the prior art package.

In addition, the stop projections of this prior patent are formed completely within the recesses in the plate shaped base and, therefore, require a high technical effort in the fabrication of the package. Such prior art projections require cavities to be provided in the initial molds for forming the plate shaped base. In addition to more complicated and costly molds, this construction causes problems in retracting packages from the mold. Moreover, inclusion of the projection forming cavities in the base plate mold as taught in the prior patent has the disadvantage that it makes the molded package suited only for needles of a certain size head, that is, for each different size needle head to be packaged, a separate mold for the entire base plate is required.

SUMMARY OF THE INVENTION

It is an object of the present invention to obviate the disadvantages of the prior art packaging by forming in the bottom of each compartment, as a transition between the even surface of the base and the sides of the compartment and side walls, which run at right angles to the base, oblique bearing surfaces for needles heads of varying diameters, and by providing projecting stops positioned above these bearing surfaces formed by nose-shaped protrusions of material derived from locally limited impressions in the compartment and side walls the depths of which are adapted for the relevant needle head diameter.

The creation of oblique bearing surfaces at the bottom of each compartment by this invention makes it possible reliably to store needles of varying thicknesses, i.e., with varying needle head diameters, in the same package, without making impossible an orderly storage of the needles in the compartments. By adjusting the locally limited impressions in the partition and side walls to the relevant needle head diameters, the nose-shaped protrusions of material that form the projecting stops can be adjusted to the type of needle to be packaged, so that a reliable container is achieved for needles of both small and large diameters with the use of the same package. Despite these advantages over the known needle packagings, the packaging according to the invention can be easily manufactured, since it requires no complicated recesses or cut-outs that require a complicated tool.

According to another characteristic of the invention, the nose-shaped protrusions of material are positioned on both side surfaces of the compartment walls and each one is positioned on the inside of the side walls. Thus, in the packaging according to the invention, the needles can be positioned with their tips running in the same direction and lying next to one another in the compartments, which considerably simplifies filling the packages.

With the invention it is further proposed that there be a discontinuity or break at about the center of the compartment walls. This break makes it possible to bend the plate-shaped base crossways to the longitudinal direction of the needles, and it thereby causes the needle tips or needle heads to protrude from their compartments, so that individual needles can easily be removed. If the discontinuity in the compartment walls according to this invention extends for approximately one-third of the way along the total length of the package, it is also possible to remove individual needles from the individual compartment by gripping them with a fingernail.

So that individual packages can be stacked one on top of the other in assembling package sets, the invention lastly proposes that on the top or bottom of the front and/or side walls protrusions or corresponding recesses be positioned to fit into one another during a stacking operation, preventing sideways slippage of the individual packages.

DESCRIPTION OF THE DRAWINGS

With the above and additional objects and advantages in view as will hereinafter appear, this invention will be described with reference to a preferred embodiment illustrated in the accompanying drawings in which:

FIG. 1 is a plan view of the needle packaging of this invention;

FIG. 2 is a cross-sectional along intersection line 2—2 in FIG. 1;

FIG. 3 is a longitudinal cross-sectional view along intersection line 3—3 in FIG. 1;

FIG. 4 is a plan view of a portion of a compartment of the packaging, depicited on an enlarged scale;

FIG. 5 is a front view of FIG. 1;

FIG. 6 is a cross-sectional view across a needle accommodating compartment including a needle head constrained therein, taken along intersection line 4—4 in FIG. 4;

FIG. 7 is a cross-sectional view similar to that of FIG. 6 but showing an embodiment constructed for a thinner needle;

FIG. 8 is a cross-sectional view across a projecting stop on a partition wall along intersection line 8—8 in FIG. 4; and FIG. 9 is a side view of the projection stop illustrated in FIG. 8.

DESCRIPTION OF THE INVENTION

The packaging illustrated in the accompanying drawings consists of a plate-shaped base 1 made of soft plastic. Front walls 2 and side walls 3 rise along the ends of the surface of this base 1, forming a circumferential edge. Base 1 has partition walls 4, parallel to side walls 3. The partition walls 4 work together with the adjacent side walls 3 and with one another to form compartments 5 each holding one needle. For this purpose the front walls 2 and side walls 3, as well as partition walls 4, are higher than the diameter of the needle head, as is particularly evident in FIGS. 6 and 7. The package base with compartments described above is preferably formed by a first plastic molding process.

To hold the needle heads K in the compartments 5, projecting stops are provided on opposite surfaces of partition walls 4 and side walls 3, which said projecting stops consist of nose-shaped protrusions 6, as can best be seen in FIGS. 8 and 9. The protrusions 6 are created by a second molding process which produces locally limited recesses 7 formed completely across the partition walls 4 or partially across the side walls 3, the depth of these recesses 7 being adapted to the relevant diameter of needle head K. For a large diameter of needle head $K_1$ as per FIG. 6, the packaging is constructed in the same manner but the recesses 7 are more shallow than is the case for a smaller needle head $K_2$ as per FIG. 7, because in the latter case the nose-shaped protrusions 6 must be larger in order to hold needle heads $K_2$ securely in compartment 5. The thickness of the nose-shaped protrusions 6 is thus altered by means of the depth of recesses 7, which said recesses 7 can be created in the packaging by means of a stamp once it is determined for which needle sizes the packaging is to be used. Protrusions 6 are thus displacements of material from partition walls 4 or side walls 3, as is particularly apparent from FIG. 9. This illustration shows that ridges of material are created in front by recesses 7, in addition to the nose-shaped protrusions 6, which said ridges of material contribute to a certain reinforcing of the nose-shaped protrusions 6.

So that needle heads K of various diameters can reliably be stored in the compartments 5, which are always constructed in the same way, oblique bearing surfaces 8 are constructed at the bottom of each compartment 5 as a transition between the even surface of base 1 and the side surfaces of partition walls 4 or side walls 3, which said side surfaces are at right angles to base 1, as shown in FIGS. 6, 7 and 8. These bearing surfaces 8 form a kind of prism on which needle heads K of varying diameters can be supported with any resulting lateral shift or downward tipping of needle heads K.

As is particularly apparent in FIGS. 2 and 3, partition walls 4 of the packaging are formed in the first molding process with a gap at the center instead of being continuous. In the embodiment shown, the break in partition walls 4 extends for approximately one-third of the total length of the package. In this way, it becomes possible to grasp the needles in the package with a fingernail, through the break in partition wall 4, and to remove individual needles from the package. The break in partition wall 4 also allows the soft plastic package to be bent along a line crossways to the axis of the package. Either the tips or the head of the packaged needles thereupon protrude from the compartment 5, so that in this way individual needles can be removed. In the latter case it is enough for the break in partition walls 4 to be a short one, since this short break is enough to allow for bending the package crossways.

Since it is normally necessary to stack several packages one on top of the other in order to form a large package, in the embodiment strip-like protrusions 9 are provided at the top of front walls 2, which said protrusions fit into mating recesses 10 in the bottom of front walls 2 when several packages are stacked one on top of another. Naturally, such protrusions 9 and recesses 10 can be provided alternatively or additionally in side walls 3 as well, and a different shape can be selected for the protrusions 9 and recesses 10.

In the packaging described above, ten needles, for example for industrial sewing machines, are packaged with their heads K lying next to one another, so that the needle tips lie protected in compartments 5 of the package. The package construction described above allows one and the same package to be used for needles having different head diameters.

We claim:

1. A package for sewing machine needles or the like comprising a block of synthetic thermoplastic material formed by a first molding process with a plurality of elongated parallel sewing needle accommodating compartments opening on the same side of the block, each said compartments being bounded on both sides by a partition composed of thermoplastic material integral with that of said block, said compartments each being formed in the block deeper than the maximum diameter of the needles to be accommodated, and needle retaining lugs formed on said partitions so as to project into said needle accommodating compartments by a second molding process which deforms the thermoplastic material at the top of the partitions creating in each partition a localized recess of which the thermoplastic material is displaced into an adjoining compartment to form one of said lugs.

2. A package for sewing needles or the like as set forth in claim 1 in which said localized recesses formed in said partitions by each second molding process reduce the height of said partitions at said localized recesses to a dimension substantially equal to that of the maximum diameter of the needles to be accommodated in said compartments.

3. A package for sewing needles or the like as set forth in claim 1 in which each needle retaining lug displaced from a partition into an adjoining compartment is formed in said second molding process with an outer surface which is inclined downwardly into said adjoining compartment.

4. A package for sewing needles or the like as set forth in claim 3 in which the bottom of each needle accommodating compartment beneath each needle retaining lug is formed in said first molding process with an oblique bearing surface inclined toward the center of said compartment facilitating centering of a needle retained in said compartment by said retaining lugs.

* * * * *